US010089939B2

(12) United States Patent
Zhang et al.

(10) Patent No.: US 10,089,939 B2
(45) Date of Patent: Oct. 2, 2018

(54) APPARATUS AND METHOD FOR CONTROLLING LIQUID CRYSTAL DISPLAY BRIGHTNESS, AND LIQUID CRYSTAL DISPLAY DEVICE

(71) Applicant: HISENSE ELECTRIC CO., LTD., Qingdao (CN)

(72) Inventors: Yuxin Zhang, Qingdao (CN); Shunming Huang, Qingdao (CN); Zhicheng Song, Qingdao (CN)

(73) Assignees: HISENSE ELECTRIC CO., LTD., Qingdao (CN); HISENSE USA CORPORATION, Suwanee, GA (US); HISENSE INTERNATIONAL CO., LTD., Qingdao (CN)

( * ) Notice: Subject to any disclaimer, the term of this patent is extended or adjusted under 35 U.S.C. 154(b) by 123 days.

(21) Appl. No.: 15/158,702

(22) Filed: May 19, 2016

(65) Prior Publication Data

US 2017/0061896 A1 Mar. 2, 2017

(30) Foreign Application Priority Data

Sep. 1, 2015 (CN) ..... 2015 1 0549986

(51) Int. Cl.
*G09G 5/10* (2006.01)
*G09G 3/34* (2006.01)

(52) U.S. Cl.
CPC ..... *G09G 3/3426* (2013.01); *G09G 2320/064* (2013.01); *G09G 2320/0646* (2013.01); *G09G 2360/16* (2013.01)

(58) Field of Classification Search
CPC ..... G09G 2320/064; G09G 2320/0646; G09G 2360/16; G09G 3/3426
See application file for complete search history.

(56) References Cited

U.S. PATENT DOCUMENTS 7,436,415 B2 10/2008 Takata et al.
7,638,754 B2 12/2009 Morimoto et al.
(Continued)

FOREIGN PATENT DOCUMENTS

CN 101236728 8/2008
CN 101271208 9/2008
(Continued)

OTHER PUBLICATIONS

Office Action from related Chinese Application No. 201510550060.5 dated Mar. 1, 2017 (11 pages).
(Continued)

*Primary Examiner* — Latanya Bibbins
*Assistant Examiner* — Sosina Abebe
(74) *Attorney, Agent, or Firm* — Harness, Dickey & Pierce, P.L.C.

(57) ABSTRACT

The disclosure provides an apparatus for controlling liquid crystal display brightness, the apparatus pre-obtaining a zone backlight value corresponding to a zone image data block according to grayscale values; if the zone backlight value is above a first threshold, multiplying the pre-obtained zone backlight value with a backlight value gain coefficient, which is more than 1, to a obtain backlight value to which a gain is applied, of a backlight zone corresponding to the zone image data block, outputting the backlight value to which the gain is applied, to a driver circuit of backlight source in the backlight zone to control brightness of the backlight source in the backlight zone as a result of driving; if the zone backlight value is below a second threshold, compensating for the grayscale values of the pixels in the zone image data block using compensation coefficients, each of which is more than 1.

18 Claims, 8 Drawing Sheets

(56) References Cited

U.S. PATENT DOCUMENTS

| | | | | |
|---|---|---|---|---|
| 2004/0257329 | A1 | 12/2004 | Park et al. | |
| 2005/0057487 | A1 | 3/2005 | Takata et al. | |
| 2005/0104838 | A1* | 5/2005 | Sasaki | G09G 3/3406 345/102 |
| 2005/0179639 | A1 | 8/2005 | Hsieh | |
| 2007/0001997 | A1 | 1/2007 | Kim et al. | |
| 2007/0030697 | A1 | 2/2007 | Kim | |
| 2007/0216636 | A1* | 9/2007 | Lo | G09G 3/3406 345/102 |
| 2007/0222730 | A1 | 9/2007 | Kao et al. | |
| 2008/0055231 | A1 | 3/2008 | Nose et al. | |
| 2008/0180383 | A1 | 7/2008 | Lin et al. | |
| 2008/0186393 | A1 | 8/2008 | Lee et al. | |
| 2008/0245949 | A1 | 10/2008 | Morimoto et al. | |
| 2008/0284719 | A1* | 11/2008 | Yoshida | G02F 1/136277 345/102 |
| 2009/0066632 | A1 | 3/2009 | Chen | |
| 2009/0128583 | A1* | 5/2009 | Choi | G09G 3/3406 345/690 |
| 2009/0167670 | A1* | 7/2009 | Peng | G09G 3/3426 345/102 |
| 2009/0189842 | A1* | 7/2009 | Huang | G09G 3/342 345/102 |
| 2010/0020005 | A1 | 1/2010 | Jung et al. | |
| 2010/0066657 | A1 | 3/2010 | Park et al. | |
| 2010/0103089 | A1* | 4/2010 | Yoshida | G09G 3/2022 345/102 |
| 2010/0164922 | A1* | 7/2010 | Nose | G09G 3/3406 345/207 |
| 2010/0245397 | A1 | 9/2010 | Choe et al. | |
| 2011/0051161 | A1* | 3/2011 | Yen | G06T 5/009 358/1.9 |
| 2011/0205442 | A1 | 8/2011 | Mori et al. | |
| 2011/0227940 | A1* | 9/2011 | Neal | G09G 3/3426 345/102 |
| 2011/0292018 | A1 | 12/2011 | Kubota et al. | |
| 2012/0249613 | A1 | 10/2012 | Takada et al. | |
| 2013/0265337 | A1* | 10/2013 | Furumoto | G09G 5/10 345/690 |
| 2015/0009249 | A1* | 1/2015 | Kudo | G09G 3/36 345/691 |
| 2015/0213781 | A1* | 7/2015 | Huang | G09G 5/10 345/207 |
| 2015/0339967 | A1 | 11/2015 | Shin | |
| 2016/0035285 | A1 | 2/2016 | Jung | |
| 2016/0284283 | A1* | 9/2016 | Kurita | G09G 3/3413 |

FOREIGN PATENT DOCUMENTS

| | | | |
|---|---|---|---|
| CN | 101329458 | | 12/2008 |
| CN | 101383139 | | 3/2009 |
| CN | 101388183 | A | 3/2009 |
| CN | 101650921 | | 2/2010 |
| CN | 101673521 | A | 3/2010 |
| CN | 201607919 | U | 10/2010 |
| CN | 102081258 | | 6/2011 |
| CN | 102137178 | A | 7/2011 |
| CN | 102243855 | A | 11/2011 |
| CN | 102292757 | A | 12/2011 |
| CN | 102473383 | | 5/2012 |
| CN | 102568386 | | 7/2012 |
| CN | 102622990 | A | 8/2012 |
| CN | 102890918 | | 1/2013 |
| CN | 103050095 | | 4/2013 |
| CN | 103106875 | A | 5/2013 |
| CN | 103310765 | | 9/2013 |
| CN | 104050934 | | 9/2014 |
| CN | 104599642 | A | 5/2015 |
| DE | 102008004281 | | 8/2008 |
| JP | 2002014660 | | 1/2002 |
| JP | 2008268798 | | 11/2008 |
| KR | 100809073 | | 2/2008 |
| KR | 20110066510 | A | 6/2011 |
| WO | 2013166994 | | 11/2013 |

OTHER PUBLICATIONS

Office Action from related Chinese Application No. 201510550060.5 dated Aug. 1, 2017 (10 pages).
Office Action from related Chinese Application No. 201510592299.9 dated Apr. 13, 2017 (10 pages).
Office Action from related Chinese Application No. 201510592299.9 dated Oct. 18, 2017 (3 pages).
Office Action from related Chinese Application No. 201510550065.8 dated Mar. 20, 2017 (13 pages).
Office Action from related Chinese Application No. 201510665186.7 dated Mar. 31, 2017 (10 pages).
Office Action from related Chinese Application No. 201510664843.6 dated Feb. 23, 2017 (8 pages).
Office Action from related Chinese Application No. 201510550126.0 dated Mar. 23, 2017 (15 pages).
U.S. Appl. No. 14/317,021, filing date Jun. 27, 2014, Zhang et al.
Office Action from Chinese Application No. 201410267408.5 dated Jul. 10, 2017 (9 pages).
Office Action from Chinese Application No. 201510665186.7 dated Nov. 28, 2017 (5 pages).

* cited by examiner

--Prior Art--

--Prior Art--

--Prior Art--

APPARATUS AND METHOD FOR CONTROLLING LIQUID CRYSTAL DISPLAY BRIGHTNESS, AND LIQUID CRYSTAL DISPLAY DEVICE

CROSS-REFERENCE TO RELATED APPLICATION

This application claims the benefit and priority of Chinese Patent Application No. 201510549986.2 filed Sep. 1, 2015. The entire disclosure of the above application is incorporated herein by reference.

FIELD

The present disclosure relates to the field of liquid crystal display technologies and particularly to an apparatus and method for controlling liquid crystal display brightness, and a liquid crystal display device.

BACKGROUND

This section provides background information related to the present disclosure which is not necessarily prior art.

A Liquid Crystal Display (LCD) device typically controls backlight brightness through dynamic backlight modulation to thereby save energy and improve the display contrast and other image quality-of-picture effects. As illustrated in FIG. 1, which is a structural principle diagram of dynamic backlight modulation in the liquid crystal display device in the prior art, the liquid crystal display device includes an image processing component configured to receive an input image signal, and to acquire backlight data as a function of grayscale brightness of the image signal, where on one hand, the image signal is converted in format according to the predetermined specification of a display panel, and output to a timing controller (TCON) in a liquid crystal display component, and a timing control signal and a data signal are generated by the timing controller to drive the liquid crystal panel; and on the other hand, the acquired backlight data are output to a backlight processing component, and the backlight data are converted by the backlight processing component into a backlight control signal to control a backlight driver component to control brightness of backlight sources in a backlight assembly so that if the brightness of the image is high, then the backlight source will be driven for high backlight brightness, and if the brightness of the image is low, then the backlight source will be driven for low backlight brightness.

SUMMARY

This section provides a general summary of the disclosure, and is not a comprehensive disclosure of its full scope or all of its features.

In an aspect, an embodiment of the disclosure provides an apparatus for controlling liquid crystal display brightness, the apparatus including: a zone image grayscale determining section configured to determine image grayscale values of pixels in a zone image data block under a predetermined rule according to a received image signal; a zone backlight value pre-obtaining section configured to pre-obtain a zone backlight value corresponding to the zone image data block according to the grayscale value; a zone backlight value gain section configured, when it is determined that the zone backlight value is above a first threshold, to multiply the pre-obtained zone backlight value with a backlight value gain coefficient to obtain a backlight value, to which a gain is applied, corresponding to the zone image data block, and to output the backlight value to which the gain is applied, to a driver circuit of backlight source in a backlight zone corresponding to the zone image data block to control brightness of the backlight source in the backlight zone as a result of driving, where the backlight value gain coefficient is more than 1; and a zone image grayscale compensating section configured, when it is determined that the zone backlight value is below a second threshold, to compensate for the grayscale values of the pixels in the zone image data block using compensation coefficients to obtain compensated image data for driving a liquid crystal panel, where each of the compensation coefficient is more than 1.

In another aspect, an embodiment of the disclosure provides a method for controlling liquid crystal display brightness, the method including: determining grayscale values of pixels in a zone image data block under a predetermined rule according to a received image signal; pre-obtaining zone a backlight value corresponding to the zone image data block according to the grayscale value; when it is determined that the zone backlight value is above a first threshold, then multiplying the pre-obtained zone backlight value with a backlight value gain coefficient to obtain a backlight value, to which a gain is applied, corresponding to the zone image data block, and outputting the backlight values, to which the gain is applied, to a driver circuit of backlight source in a backlight zone corresponding to the zone image data block to control brightness of the backlight source in the backlight zone as a result of driving, wherein the backlight value gain coefficient is more than 1; and if when it is determined that the zone backlight value is below a second threshold, then compensating for the grayscale values of the pixels of in the zone image data block using compensation coefficients to obtain compensated image data for driving a liquid crystal panel, wherein each of the compensation coefficient is more than 1.

In a further aspect, an embodiment of the disclosure provides a liquid crystal display device including: a memory configured to store programs and various preset lookup table data; an apparatus for controlling liquid crystal display brightness configured to execute the programs in the memory, and to invoke the various lookup table data according to the executed programs; to receive an image signal, to process the data, and to output image data to a timing controller so that the timing controller generates a driver signal according to the image data to control a liquid crystal panel to display an image; and to output zone backlight values to a backlight processing module according to the image signal; the backlight processing module configured to determine duty ratios of corresponding PWM signals according to the respective zone backlight values, and to output the duty ratios to a PWM driver module; and the PWM driver module configured to generate PWM control signals to control backlight sources in backlight zones; wherein the apparatus for controlling liquid crystal display brightness is the apparatus above for controlling liquid crystal display brightness.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

Dynamic backlight modulation generally includes zoned backlight modulation and global backlight modulation, where in global backlight modulation, the backlight brightness is controlled by acquiring the average brightness over one frame of image so that the real backlight brightness is determined by the average grayscale value across the frame of image, so the maximum average grayscale value over the image (i.e., the all-white image) corresponds to the maximized backlight brightness, and in order to guarantee the reliability of the backlight source in operation, the maximized backlight brightness is typically controlled below rated brightness of the backlight source in operation. Typically, in a normally displayed picture, the average grayscale brightness across the entire dynamic video picture can be statistically known at around 50% IRE, so that the average value of the backlight brightness will be around 50% of the maximized backlight brightness. Thus, the real average power of the backlight source operating with global backlight modulation is controlled around half the rated power, and there is some apparent effect of saving energy. However in global backlight modulation, the average grayscale brightness across one or more consecutive frames of image is acquired, and global backlight source brightness is controlled by the average grayscale brightness of the image(s), but the average grayscale brightness of the image(s) may not reflect brightness details between local pictures of the images, and a variation in contrast of the image(s) will be more reflected in the difference in brightness between the local pictures of the images, and thus may not significantly improve the quality-of-picture effect for the display contrast.

Figure 1:
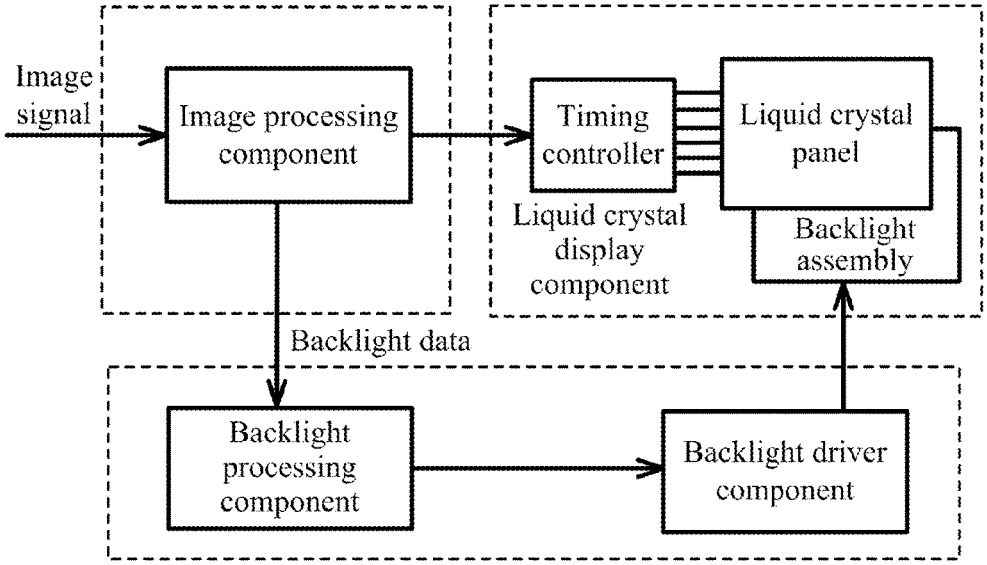
FIG. 1 is a structural principle diagram of dynamic backlight modulation in the liquid crystal display device in the prior art.
Figure 2:
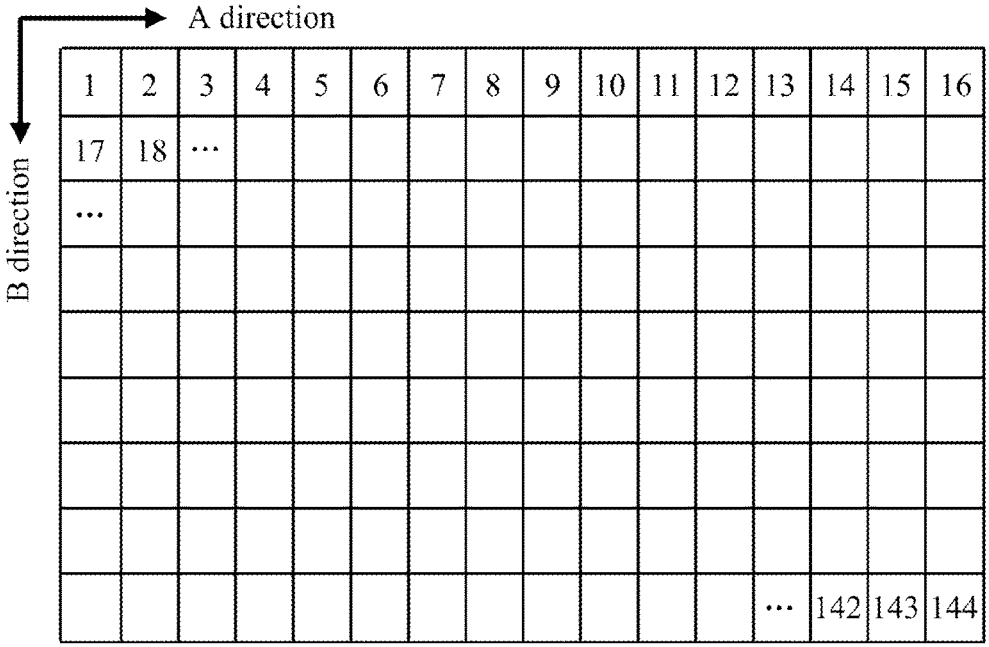
FIG. 2 is a schematic diagram of backlight zones in zoned dynamic backlight modulation in the prior art.

In zoned dynamic backlight modulation, as illustrated in FIG. 2 which is a schematic diagram of backlight zones in zoned dynamic backlight modulation in the prior art, the entire matrix of backlight sources includes M zones in the direction A and N zones in the direction B, and as illustrated, if M=16 and N=9, then there will be M*N=144 backlight zones in total, in each of which the backlight source brightness can be controlled separately as a result of driving, where it shall be noted that if the respective backlight zones are ideal, then they can illuminate their backlight areas separately, but in fact, the brightness of the adjacent backlight sources may be affected somewhat. In zoned dynamic backlight modulation, each frame of global image is segmented into a number of zone image data blocks corresponding to the backlight zones, and grayscale data in the respective zone image data blocks are acquired to obtain the backlight data of the corresponding backlight zones, and the obtained backlight data of the respective zones reflect the differences in brightness between the corresponding zone image data blocks, so that the backlight brightness of the backlight zones will be determined by the brightness of the image data blocks corresponding to the backlight zones, and the variations in backlight brightness of the zones will reflect the grayscale brightness in the zone image data blocks in which area pictures need to be displayed, and highlight the differences in display brightness between the local pictures of the displayed image, thus improving the contrast quality-of-picture effect of the dynamic picture.

Figure 3:
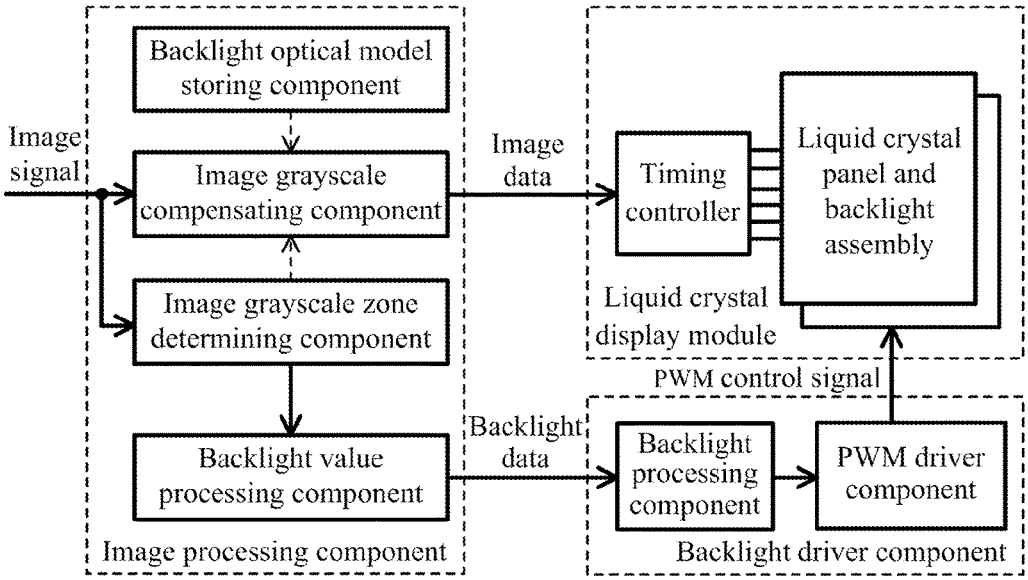
FIG. 3 is a structural diagram of obtaining backlight values of backlight zones in zoned dynamic backlight modulation in the prior art.

In the prior art, the backlight values of the backlight data of the image are acquired in zoned dynamic backlight modulation as illustrated in FIG. 3, an image processing component receives an input image signal, where on one hand, an image grayscale zone determining module is configured to determine a brightness grayscale of each image pixel in a zone image data block in the image signal, and a backlight value processing module is configured to obtain a backlight value of the zone from a determination result, where the backlight value can be obtained particularly as the maximum value, the average value, the average value of weighted values, the weighted value of average values, etc.; and on the other hand, in order to compensate for a difference in display brightness of the image arising from different backlight brightness in the different backlight zones, an image grayscale compensating module can further perform a predetermined image data grayscale compensation algorithm on the backlight value in each backlight zone according to a preset function relationship in a backlight optical model storing module, and obtain and output compensated image data to a timing controller to drive the liquid crystal panel to display the image. Particularly in the algorithm above for obtaining the backlight value, for example, if the image grayscale of each image pixel ranges from 0 to 255, then the backlight value of the zone will be obtained as any one value from 0 to 255; and then a backlight processing module receives and then converts directly the any one backlight value from 0 to 255 into a PWM backlight drive signal to drive the backlight sources in the zone, where the backlight source is driven by the maximum backlight value of 255 accordingly for the maximum backlight brightness, and the backlight source is driven by any other backlight value between 0 and 255 for lower peak brightness than the maximum backlight brightness. As can be known from an analysis thereof, the index of picture contrast is determined by the maximum peak brightness and the minimum display brightness, i.e., the ratio of display brightness of a picture at the display grayscale value of 255 to display brightness of a picture at the display grayscale value of 0, but the brightness of the picture at the display grayscale value of 0 is typically predetermined and hardly influenced by the backlight brightness, so the maximum peak brightness is a predominating factor of the index of displayed picture contrast. As can be known from the analysis above, since the backlight peak brightness of each zone is limited to the maximum backlight value of 255, if the maximum peak brightness of the respective zones is limited to the maximum backlight value of 255, then an improvement to the contrast of the displayed picture may be discouraged.

In order to improve the effect of a dynamic contrast quality-of-picture of a displayed image in the liquid crystal display device, zoned dynamic backlight modulation is applied so that the entire matrix of backlight sources thereof is divided into a number of backlight zones in row and column directions, and backlight sources in each backlight zone can be driven separately to drive brightness thereof, where it shall be noted that ideally the respective backlight zones can illuminate separately their backlight zones, but in fact, the brightness of the adjacent backlight sources may be affected somewhat. Image grayscale brightness of zone image data blocks displayed on a liquid crystal display panel corresponding to the backlight zones is acquired, backlight values of the backlight zones are obtained as a function of the image grayscale brightness in an algorithm of obtaining the backlight values, and the backlight sources in the zones are driven by the backlight values to emit light so as to provide desirable backlight brightness for the image in the zones to be displayed. It shall be noted that the zone image data blocks refer to that the liquid crystal display panel is zoned uniformly under the same zoning rule as the backlight zones, and image data of all the pixels displayed in the display zones of the liquid crystal panel at the same positions as the backlight zones are aggregated, where the backlight zones may not overlap completely with the boundaries of the areas displayed on the liquid crystal panel corresponding to the zone image data blocks due to a design error and a process error, or taking into account a design need or other factors, and it shall be further noted that the backlight zones, and the zones of the liquid crystal panel relate to virtual boundaries instead of physical boundaries in a real design.

In a method and apparatus for controlling liquid crystal display brightness, and a liquid crystal display device according to some preferred embodiments of the disclosure, in areas of pictures at low brightness, since backlight brightness thereof is not a bottleneck limiting the brightness of the displayed image, grayscale values of pixels can be compensated for in this embodiment by compensating for the grayscale values of the respective pixels so that the different grayscale values of the different pixels are compensated for by different compensation amplitudes, thus improving the difference in brightness between the displayed pictures of the image so as to enhance the sense of hierarchy. A bottleneck limiting the display brightness of the image in areas of pictures at high brightness is backlight peak brightness; and if the grayscale values of the pixels in the image are compensated for, then the brightness of the displayed image cannot be improved due to the limited maximum backlight peak brightness, so the backlight peak brightness will be improved in the areas of the pictures at high brightness to thereby address the sense of hierarchy in the picture. Thus each frame of pictures can be displayed by compensating grayscales of respective pixels in an area of a picture at low brightness to improve the sense of hierarchy in the picture, and enhancing backlight brightness of backlight zones in an area of a picture at high brightness to improve the sense of hierarchy in the picture, so that the overall sense of hierarchy in the image can be improved to thereby improve the effect of the dynamic contrast of the pictures.

However, as can be apparent from the analysis in the Background section, in order to address the limited algorithm in which the backlight values are obtained in the prior art, so as to further improve the effect of the contrast quality of picture in the image displayed by the liquid crystal display device using dynamic backlight control on the zones, the disclosure proposes a method and apparatus for controlling liquid crystal display brightness, and a liquid crystal display device.

All the embodiments of the disclosure relate to an 8-bit ($2^8$=256 grayscales) liquid crystal display screen by way of an example.

Figure 4:
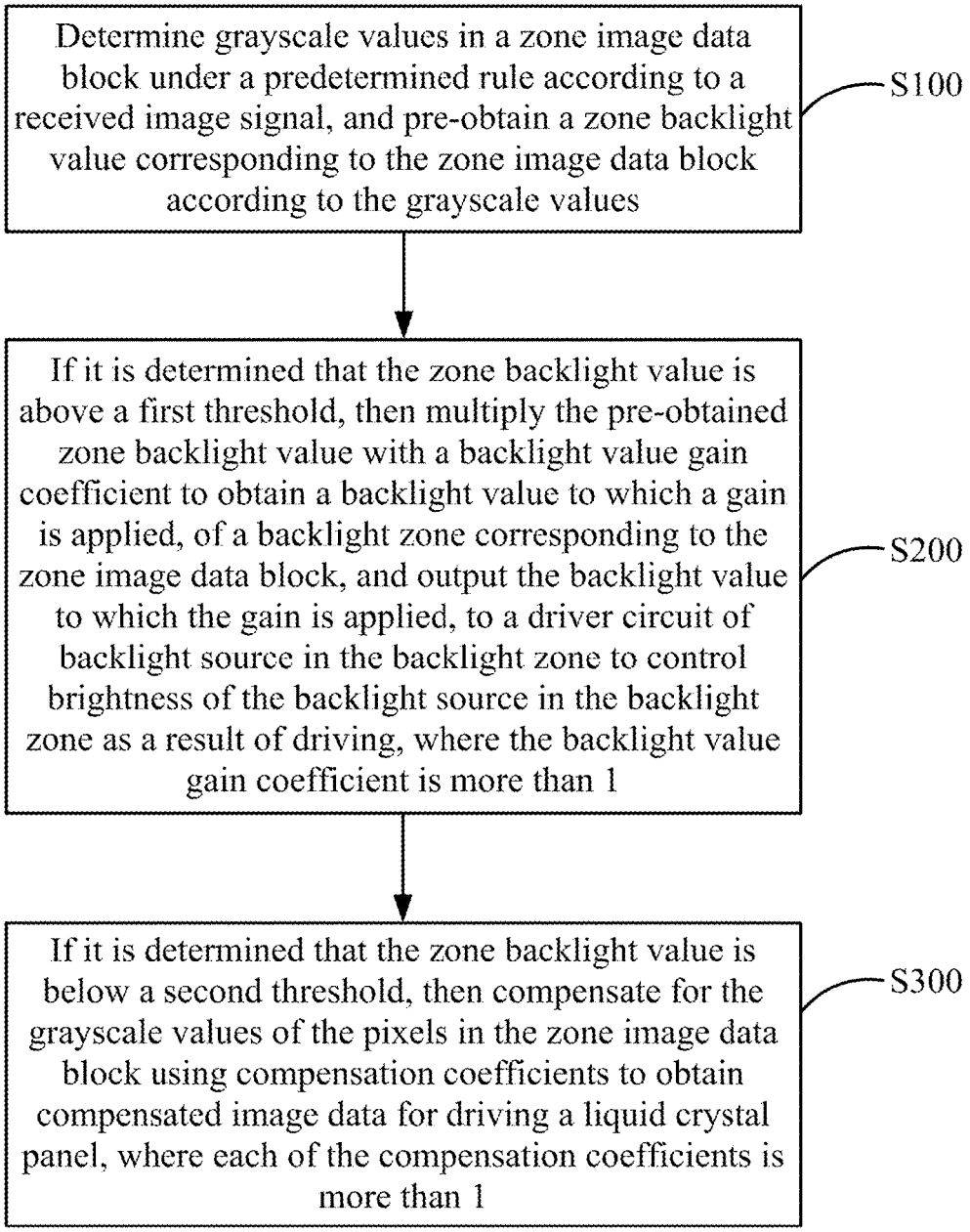
FIG. 4 is a schematic flow chart of a method for controlling liquid crystal display brightness according to a first embodiment of the disclosure.

A first embodiment of the disclosure provides a method for controlling liquid crystal display brightness, and as illustrated in FIG. 4 which is a schematic flow chart of a method for controlling liquid crystal display brightness according to the first embodiment of the disclosure, an executor of this embedment can be an image processing device in which processing and storing functions are integrated. The image processing device can be a single video processing chip, or consisted of a number of video processing chips cooperating with each other, and can be arranged in a liquid crystal display device with controlled zoned dynamic backlight, where the liquid crystal display device can be a liquid crystal TV set, a liquid crystal display, a tablet computer, etc.; and with this method, backlight values for driving brightness of backlight sources in respective backlight zones are generated for an input image signal to improve the effect of display contrast of the image as a whole, and the method for controlling liquid crystal display brightness includes:

The operation S100 is to determine grayscale values of pixels in a zone image data block under a predetermined rule according to a received image signal, and to pre-obtain a zone backlight value corresponding to the zone image data block according to the grayscale values.

In this embodiment, the predetermined rule can be a pre-stored function model in which a liquid crystal panel is divided into a number of virtual zones at the same proportion as the backlight zones, and image data of all pixels displayed in one of the virtual zones are aggregated into a zone image data block.

Particularly the zone backlight value of each zone image data block is pre-obtained from the grayscale values of the pixels in a backlight zone corresponding to the zone image data block in a preset algorithm, where the pre-obtained zone backlight value is not finally used to drive the backlight sources, but a gain will be further applied to the pre-obtained zone backlight value and/or the pre-obtained zone backlight value will be adjusted, thus resulting in a final backlight value.

It shall be noted that the preset algorithm can be an algorithm of averaging the grayscales of all pixels, or can be an algorithm of averaging the maximum values of red, green, and blue sub-pixels in the respective pixels, or can be an algorithm of averaging their weighted grayscales, where weight coefficients thereof can be preset; and those skilled in the art can devise other particular algorithms of obtaining the backlight values without any inventive effort, and the backlight data of the zones can be obtained in alternative algorithms in this embodiment and other embodiments, so the embodiments of the disclosure will not be limited thereto.

By way of an example, the matrix of backlight sources in the liquid crystal display device is divided into 16 zones in the row direction and 9 zones in the column direction, so that the entire matrix of backlight sources are divided into 144 backlight zones, in each of which the backlight sources can be driven separately to control brightness, where the brightness can be controlled through current or PWM-controlling, and the backlight sources can be LED backlight sources. The resolution of the liquid crystal display panel in the liquid crystal display device is 3840*2160, and accordingly there are 16*9 virtual zones on the liquid crystal display panel under a backlight zoning rule. As per the positions where the virtual zones of the image data on the liquid crystal display panel are displayed, the image data are segmented into 16*9 zone image data blocks according to the predetermined function model, where each zone image data block includes 240*240 pixels, so the 240*240 pixels in each zone image data block are displayed on one virtual zone of the display panel at display brightness controlled by the backlight sources in the corresponding backlight zone. Then grayscale values of the 240*240 pixels in the one zone image data block are determined, the average of the grayscale values of the zone image data block is obtained as 160 in the predetermined backlight algorithm, and the pre-obtained zone backlight value of the corresponding backlight zone is obtained as 160; and the pre-obtained zone backlight values of the other backlight zones are obtained similarly.

It shall be noted that the backlight zone may not overlap completely with the boundary of the area displayed on the liquid crystal panel corresponding to the zone image data block due to a design error and a process error, or taking into account a design need and other factors, that is, the real number of pixels in the zone image data block may be more than 240*240, so that there may be pixels overlapping between the adjacent zone image data blocks.

The operation S200 is, when it is determined that the zone backlight value is above a first threshold, to multiply the pre-obtained zone backlight value with a backlight value gain coefficient to obtain a backlight value to which a gain is applied, of a backlight zone corresponding to the zone image data block, and to output the backlight value to which the gain is applied, to a driver circuit of backlight source in the backlight zone to control brightness of the backlight source in the backlight zone as a result of driving, where the backlight value gain coefficient is more than 1.

In this first embodiment, it is determined whether the backlight values of the respective zone is above the first threshold, and if so, which indicates bright picture of image in the zone, then the gain will be applied to the backlight value to thereby improve the sense of hierarchy in the displayed pictures of the zones, where the zone backlight value is the pre-obtained backlight values. The pre-obtained zone backlight value is multiplied with the backlight value gain coefficient to obtain the backlight value to which the gain is applied, of the backlight zone, where the backlight value gain coefficient is more than 1.

In this embodiment, the zone backlight values of the respective backlight zones are pre-obtained respectively as in the operation S100 in which the zone backlight values are pre-obtained, and then the zone backlight values are multiplied respectively with the backlight value gain coefficient to obtain the backlight values, to which the gain is applied, of the respective backlight zones. Since the backlight value gain coefficient is more than 1, then the backlight values, to which the gain is applied, of the respective backlight zones, as a result of the multiplication are more than the pre-obtained zone backlight values, so that if the backlight of the zones is driven using the backlight values to which the gain is applied, then the peak brightness will be improved, and as can be apparent from the analysis in the Background section, the improvement of the peak brightness in the zones can enhance the contrast of the displayed pictures of the image.

It shall be noted that those skilled in the art can select the particular value of the backlight value gain coefficient as needed for the design, for example, if the backlight value gain coefficient is taken as 1.5, then each zone backlight value will be pre-obtained and multiplied respectively with the backlight value gain coefficient of 1.5, or if the backlight value gain coefficient is taken as 2, then each zone backlight value will be pre-obtained and multiplied respectively with the backlight value gain coefficient of 2. In order to ensure the reliability of the backlight sources being lightened, it will not be appropriate for the amplitude of the gain to be two large, and the parameter can be selected by those skilled in the art without any inventive effort.

By way of an example, as in the operation S100, a zone backlight value is pre-obtained as 160 in a backlight zone, and multiplied with the backlight value gain coefficient of 2 to obtain the backlight value of the zone, to which the gain is applied, as 320, so that the backlight value to which the gain is applied can be improved significantly, and the peak brightness of the backlight zone can be improved significantly by driving the backlight sources of the backlight zone using the backlight value to which the gain is applied, thus enhancing the effect of the contrast quality of picture.

In this embodiment, the backlight value gain coefficient can be some defined value more than 1 for all image frames, so that the backlight value gain coefficient will be the same for the backlight value of each zone in a picture of a frame of image, and also the same for different frames of images, so the same backlight value gain coefficient will apply to all backlight zones in all the frames of images.

Figure 6:
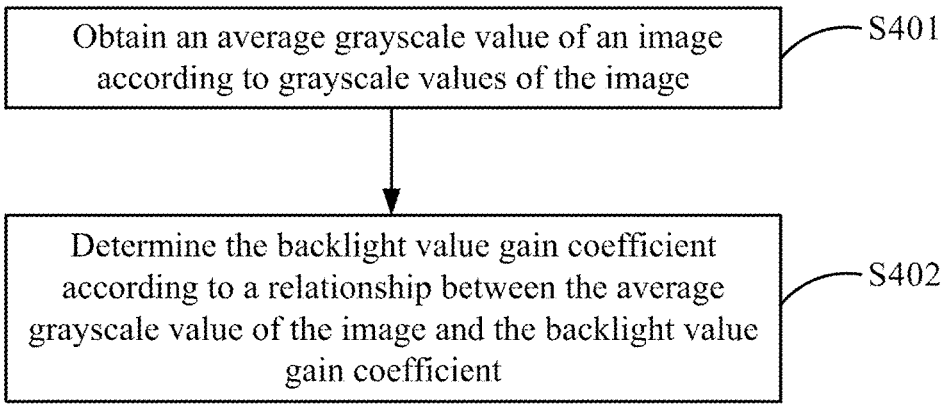
FIG. 6 is a schematic flow chart of a method for obtaining a backlight value gain coefficient according to the first embodiment of the disclosure.

Furthermore in another embodiment of the disclosure, particularly the backlight value gain coefficient can be obtained particularly by presetting a lookup table, and as illustrated in FIG. 6 which is a schematic flow chart of a method for obtaining a backlight value gain coefficient according to the first embodiment of the disclosure, the flow particularly includes:

The operation S401 is to obtain an average grayscale value of a global image according to the grayscale values.

Figure 5:
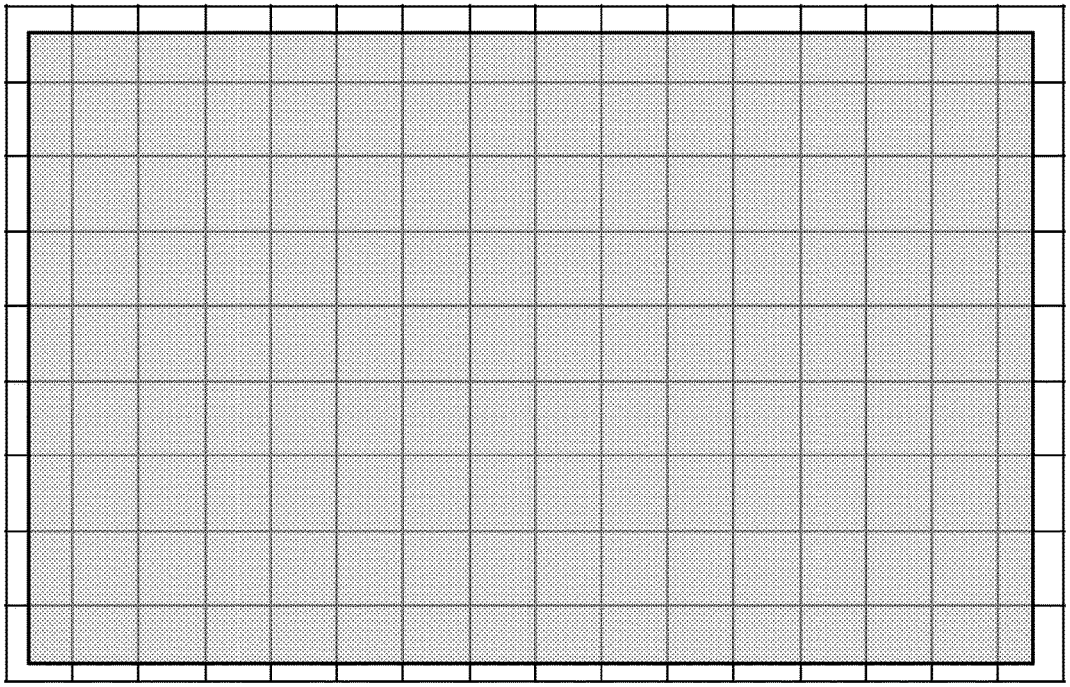
FIG. 5 is a schematic diagram of a display area segmented into zone image data blocks according to the first embodiment of the disclosure.

By way of an example, as illustrated in FIG. 5, which is a schematic diagram of a display area segmented into image data blocks according to the first embodiment of this disclosure, and as illustrated in FIG. 2 and FIG. 5A together, alike the display panel is divided into 144 virtual zones under the backlight zoning rule, a global image displayed at the corresponding position on the display panel is segmented into 144 zone image data blocks, the grayscale values of all pixels in each zone image data block are obtained respectively, and then the average of the grayscale values is obtained in the preset algorithm, which can be an algorithm of averaging the grayscales of all pixels, or can be an algorithm of averaging the maximum values of red, green, and blue sub-pixels in the respective pixels, or can be an algorithm of averaging their weighted grayscales, where weight coefficients thereof can be preset; and those skilled in the art can devise other particular algorithms of obtaining the backlight values without any inventive effort, and the backlight data of the zones can be obtained in alternative algorithms in this embodiment and other embodiments, so the embodiments of this disclosure will not be limited thereto.

It shall be noted that in the preset algorithm, average grayscale value of each of the zone image data blocks can be calculated according to firstly the operation S100, and then an average grayscale value of all the zone image data blocks can be obtained according to the average grayscale value of each of the zone image data blocks so as to obtain an average grayscale value of a global image.

Alternatively, firstly grayscale values of all pixels in a global image can be obtained, and then an average grayscale value of the global image can be obtained from the grayscale values of all the pixels in the preset algorithm.

The operation S402 is to determine the backlight value gain coefficient according to a relationship between the average grayscale value of the global image and the backlight value gain coefficient.

Particularly a backlight value gain coefficient lookup table needs to be pre-stored, in which the correspondence relationship between the average grayscale value of the global image and the backlight value gain coefficient is recorded, where the average grayscale value is mapped to the gain coefficient; and there are 256 grayscale values in total from 0 to 255 on the transverse axis, and each grayscale value corresponds respectively to a backlight value gain coefficient. The lookup table is searched for the backlight value gain coefficient corresponding to the average grayscale value using the average grayscale value.

Figure 7:
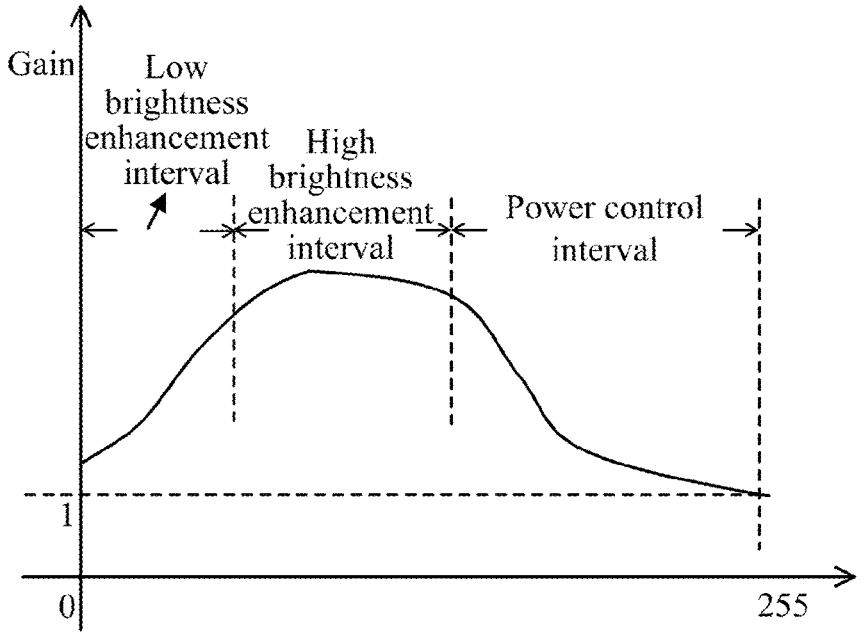
FIG. 7 is a schematic diagram of a backlight value gain curve according to the first embodiment of the disclosure.

By way of an example, as illustrated in FIG. 7 which is a schematic diagram of a backlight value gain curve according to the first embodiment of this disclosure, the gain curve can be particularly divided into a low brightness enhancement interval, a high brightness enhancement interval, and a power control interval while the average grayscale value is increasing, where gain coefficients in the high brightness enhancement interval are more than those in the low brightness enhancement interval and the power control interval respectively. If the average grayscale value of the global image is low, e.g., the average grayscale value ranges from 0 to 100, then it will lie in the low brightness enhancement interval, and the gain coefficient will increase with the increasing brightness of the global image, where if the brightness of the global image is low, then the gain coefficient will approach 1, and the amplitude of the backlight value gain will be low; and as the brightness of the global image is increasing, the gain coefficient will be increasing, and the amplitude of the backlight value gain will also be increasing. If the average grayscale value of the global image is further increasing, for example, the average grayscale value ranges from 100 to 200, then it will lie in the high brightness gain interval; and since the corresponding brightness of the grayscale of the image in the high brightness gain interval is intermediate, there will be a lot of hierarchal details of the image, and the amplitude of the gain will be large, thus highlighting the sense of hierarchy in the pictures, where the maximum value of the gain coefficient lies in the high brightness gain interval. Particularly, particular parameters for the position of the maximum value of the gain coefficient on the curve, and the particular data thereof can be selected by those skilled in the art without any inventive effort. If the brightness of the global image is very high, for example, the average grayscale value ranges from 200 to 255, then since the overall brightness of the image is high, the brightness of the image is substantially saturated, the details of the image become less, and the brightness of the entire pictures in the backlight area is sufficiently high, so that human eyes become less sensitive to the high brightness of the image in this area, and thus it will be substantially unnecessary to further enhance the brightness of backlight, and on the contrary, power consumption will be controlled by lowering the amplitude of the backlight gain. Accordingly, the gain coefficient will become less while the average grayscale value of the global image is further increasing.

It shall be noted that in this embodiment, the backlight value gain coefficient corresponds to the grayscale brightness of the global image in each frame of image in a one-to-one manner, and the grayscale brightness of the frame of global image is uniquely determined in the preset algorithm, where the determined average grayscale value corresponds to a determined backlight value gain coefficient. While a frame of pictures are being displayed, all the backlight values in the respective backlight zones with the backlight values above the first threshold are multiplied with the same backlight value gain coefficient. However, for typically consecutively displayed moving pictures, different average grayscale values are obtained for different frames of images, so the different frames of images correspond to different backlight value gain coefficients. As can be apparent from the analysis above, the different backlight value gain coefficients will result in different gain amplitudes of backlight brightness, so that the different gain amplitudes of backlight will be generated as a function of the changing image to thereby improve the dynamic contrast of the displayed pictures and control the power consumption of the backlight sources.

It shall be noted in the first embodiment, in order to improve the peak brightness in the backlight zones, the same frame of pictures can be displayed by applying the backlight gain at the same proportion of amplitude to the backlight zones with the zone backlight values above the first threshold to thereby address the problems of the insufficient peak brightness in the backlight zones and consequential poor presentation of the peak brightness of the entire image.

For the sake of a comparative description, for backlight scanning while a frame of pictures are being displayed, if all the backlight values in the respective backlight zones are multiplied with the same gain coefficient for backlight scanning of a frame of pictures being displayed, then the backlight brightness corresponding to a brighter local area in the picture of the image can be enhanced, but also the backlight brightness corresponding to a darker local area in the picture of the image can be enhanced at the same proportion, for example, the backlight brightness in a darker area of a black picture can become higher as a whole, so that if the dark area of the picture is improved in backlight brightness, then the part of the image at lower brightness may come with the phenomenon of "black floating" (floating black). Stated otherwise, the display brightness corresponding to a black image at the grayscale of 0 is typically controlled around 0.1 to 0.3 nit, i.e., reference black, so that if the backlight brightness in the black picture is improved, then the display brightness of the reference black will be far higher than 0.1 to 0.3 nit, that is, the picture in the reference black may be distorted in brightness. Since human eyes are sensitive to the appearing black picture, the distribution in brightness of the black picture will be a factor influencing the effect of the contrast quality of picture.

Figure 9:
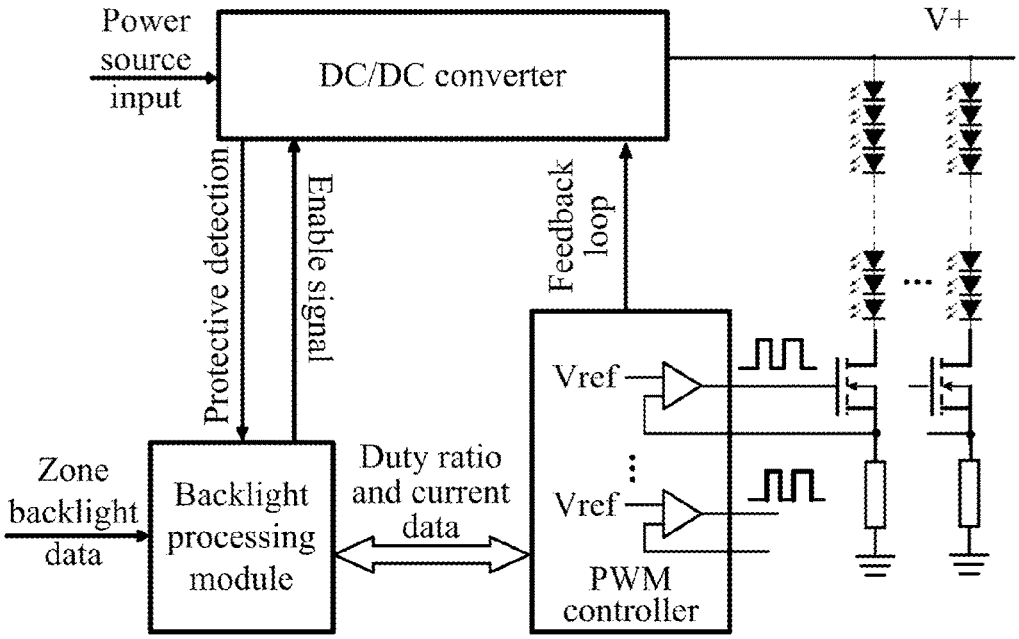
FIG. 9 is a structural diagram of drivers in backlight sources according to the first embodiment of the disclosure.

Furthermore in some embodiments of the disclosure, as illustrated in FIG. 9 which is a structural diagram of the backlight source driver in the first embodiment of the disclosure, the backlight processing module outputs the respective zone backlight values to which the gain is applied, to the driver circuits of the backlight sources in the respective zones, and determines duty ratios of corresponding PWM signals according to the backlight data of the respective zones, where if the backlight data are a brightness value ranging from 0 to 255, then the duty ratio of the PWM signal will become larger as the brightness value is increasing, and the backlight processing module sends the determined duty ratios of the PWM signals to PWM controllers corresponding to the real backlight elements, and the PWM controllers output control signals as a function of the duty ratios to the real backlight elements to control MOS transistors connected with strings of LED lamps to be switched on and off so as to control the real backlight elements to generate brightness corresponding to the backlight data. When the PWM controllers control the real backlight elements according to the PWM duty ratios to generate the brightness corresponding to the backlight data, the amplitudes of the PWM signals can be a preset value, that is, preset current is output in reality.

In other embodiments of the disclosure, the backlight processing module can further send current data in advance to the PWM controllers, and the PWM controllers can adjust the real output current according to the current data and preset reference voltage to thereby control the real backlight elements to generate the brightness corresponding to the backlight data, where there is higher backlight brightness corresponding to larger output current given a duty ratio. The real output current Iout=(current data/Imax)×(Vref/Rs), where Vref represents the preset reference voltage, e.g., 500 mV, and Rs represents the resistance of a current sampling resistor below an MOS transistor, e.g., 1Ω. The current data are typically set by operating registers in the PWM controller, and if the bit width of the register is 10 bit, then Imax=1024 in the equation above, so the current data can be calculated as a function of Tout required in reality. For example, if current of 250 mA is required, then the current data will be set 512 in the equation above. The PWM controllers typically include a number of cascaded chips, each of which can further drive a number of PWM signals to be output to the strings of LED lamps.

It shall be noted that as illustrated in FIG. 9, a DC/DC converter is configured to convert voltage output by a power source into voltage required for a string of LED lamps, and to maintain the stable voltage as a function of a feedback from a feedback circuit. The backlight processing module can be detected for protection, where the backlight processing module can send an enable signal to the DC-DC converter after being started into operation so that the DC/DC converter starts to detect the backlight processing module for protection from over-voltage or over-current.

The operation S300 is, when it is determined that the zone backlight value is below a second threshold, to compensate for the grayscale values of the pixels of in the zone image data block using compensation coefficients to obtain compensated image data for driving a liquid crystal panel, where each of the compensation coefficient is more than 1.

In this first embodiment, if the zone backlight value is below the second threshold, which indicates dark pictures of the image in the zones, then the image will be compensated for to thereby improve the sense of hierarchy in the displayed pictures of the zones, where the zone backlight value can be the pre-obtained backlight value, or the backlight value to which the gain is applied. Particularly the grayscale values of the pixels in the zone image data block are compensated for in grayscale using the compensation coefficient more than 1.

Particularly in this embodiment, the image grayscale compensation coefficient lookup table can be pre-stored, and searched for the grayscale compensation coefficient using grayscale values in the zone image data block, where a relationship between a grayscale value and a compensation coefficient is recorded in the grayscale compensation coefficient lookup table. Here a grayscale value of corresponds to a compensation coefficient in a one-to-one manner, and different grayscale values correspond to different compensation coefficients. In order to alleviate the problem of the lost details in the picture at low brightness, if the zone backlight value is so small that it is below the second threshold, then the compensation coefficient will be more than 1, and the grayscale brightness of the pixels in the backlight zone of the picture at low brightness can be compensated for respectively so that there will be a sense of hierarchal display brightness between the pixels in the zone without incurring the problem of the lost details in the picture at low brightness.

By way of an example, the black image at the grayscale value of 0 in "reference black" is multiplied with the compensation coefficient larger than 1 to obtain the compensated image which still is a black image at the grayscale value of 0, thus eliminating the problem of "black floating" of "reference black"; and the image at a higher grayscale value than "reference black", e.g., an image at low brightness at the grayscale of 6, is multiplied with the compensation coefficient larger than 2 to obtain an image at low brightness at the grayscale of 12, thus improving the sense of hierarchal brightness between the image at low brightness and the reference black.

In this embodiment, in order to address the problem of the insufficient sense of presented hierarchy in the picture at low brightness, grayscale values of pixels in an image in the display area of the picture at low brightness are enhanced respectively for compensation to thereby enhance the sense of hierarchy between the respective pixels of the image, and the sense of hierarchical display brightness is improved due to the backlight gain in the area of the picture at high brightness, so that there will be a strong hierarchy of displayed details of a global image. Stated otherwise, the grayscales of the pixels in the same frame of displayed pictures can be compensated for to thereby guarantee the sense of hierarchy in the areas of the pictures at low brightness, and the gain can be applied to the backlight peak brightness to thereby guarantee the sense of hierarchy in the areas of the pictures at high brightness, so that the sense of hierarchy in the pictures can be improved as a whole.

It shall be further noted that as can be apparent from the analysis above in this first embodiment, if the gain is applied to the backlight in the area of the picture at low brightness, then the problem of "black floating" will come therewith, and since the backlight brightness thereof is not a bottleneck limiting the contrast of the picture, the grayscale values of the pixels can be compensated for in this embodiment by compensating for the grayscale values of the pixels so that the different grayscale values of the different pixels are compensated for by different compensation amplitudes, thus improving the difference in brightness between the displayed pictures of the image so as to enhance the sense of hierarchy. A bottleneck limiting the contrast of the picture in the area of the picture at high brightness is insufficient backlight peak brightness; and if the grayscale values of the pixels in the image are compensated for, then the brightness of the displayed image cannot be improved due to the limited maximum backlight peak brightness, so the backlight peak brightness will be improved in the area of the picture at high brightness to thereby address the sense of hierarchy in the picture. Thus each frame of pictures can be displayed by compensating grayscales of respective pixels in an area of a picture at low brightness to improve the sense of hierarchy in the picture, and enhancing backlight brightness of a backlight zone in an area of a picture at high brightness to improve the sense of hierarchy in the picture, so that the overall sense of hierarchy in the image can be improved to thereby improve the effect of the dynamic contrast of the pictures.

Figure 8:
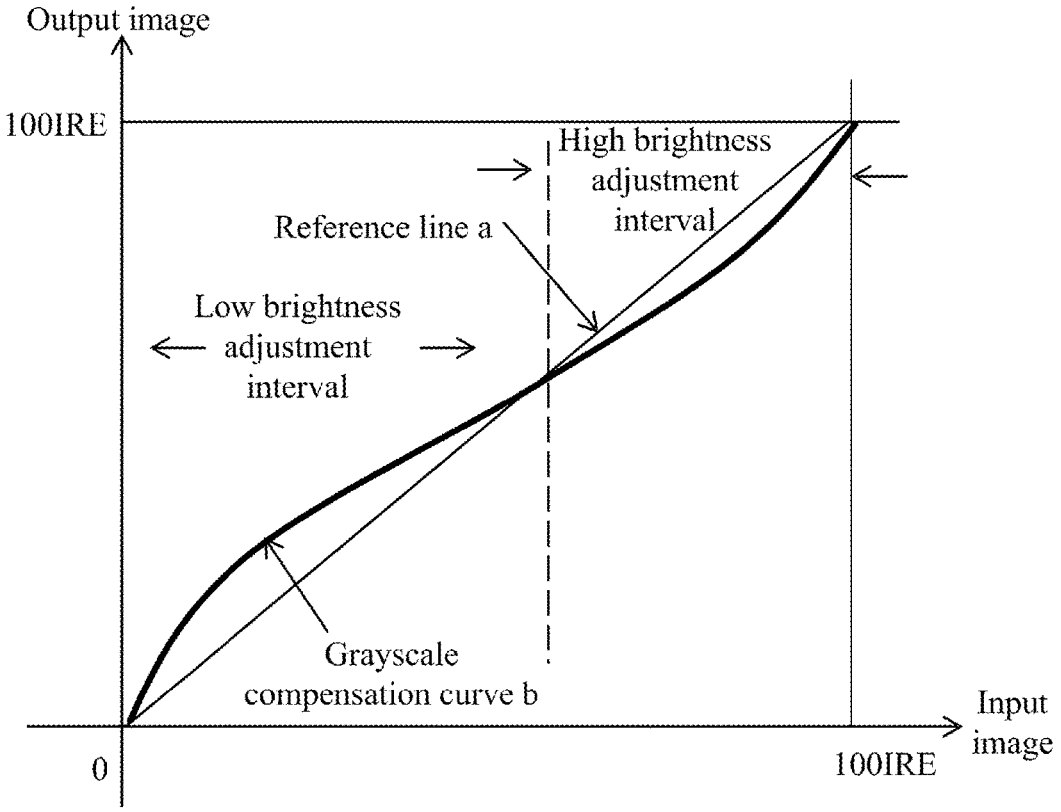
FIG. 8 is a schematic diagram of the image grayscale compensation curve according to the first embodiment of the disclosure.

Furthermore in another embodiment of the disclosure, as illustrated in FIG. 8 which is a schematic diagram of the image grayscale compensation curve according to the first embodiment of the disclosure, the grayscale compensation curve b is an inverted "S"-like curve, where the traversal axis represents an input grayscale value, the vertical axis represents an output grayscale value, the compensation coefficient is the ratio of output image brightness to input image brightness, and a reference line a represents a reference line with the compensation coefficient of 1. Here low input image brightness lies in a low brightness compensation interval, and high input image brightness lies in a high brightness compensation interval; and the low brightness compensation interval and the high brightness compensation interval are by a threshold of the input image brightness value on the traversal axis. The compensation coefficient of more than 1 in the low brightness compensation interval lies above the reference line a; and the compensation coefficient of less than 1 in the high brightness compensation interval lies below the reference line a, respectively.

In this embodiment, the backlight zones with the backlight values below the second threshold are determined, and the grayscale compensation coefficient is obtained in the low brightness compensation interval to compensate for the grayscale data of the zone image data blocks.

Furthermore in order to prevent display brightness of the image from being saturated due to the improvement of the backlight peak brightness in the zone, and the hierarchy at high brightness from being consequentially degraded, in another embodiment of the disclosure, if it is determined that the backlight value of the zone is above a fourth threshold, then a lookup table is searched in the high brightness compensation interval for a compensation coefficient using the grayscale value of each image pixel in the zone image data block, and the grayscale value of the image pixel is compensated for using the compensation coefficient to obtain compensated image data for driving the liquid crystal panel, where the compensation coefficient is less than 1.

Stated otherwise, in a zone of a picture at low brightness, in order to address an improvement of the sense of hierarchy in the displayed image, grayscale brightness of pixels in the zone will be improved differently.

It shall be noted that those skilled in the art can select the range of the low brightness compensation interval and the range of the high brightness compensation interval as particularly required for the design. Moreover the varying trend of the curve can be a folded line or a smooth curve, and the compensation coefficient in the high brightness compensation interval varies in such a trend that it firstly decreases from 1 to the minimum value gradually, and then increases from the minimum value to 1 gradually, and the compensation coefficient in the low brightness compensation interval varies in such a trend that it firstly increases from 1 to the maximum value gradually, and then decreases from the maximum value to 1 gradually, where the minimum value and the maximum value can be set as required for the design.

It shall be noted that in this first embodiment, in the areas of the pictures at low brightness, since the backlight brightness thereof is not a bottleneck limiting the brightness of the displayed image, the grayscale values of the pixels can be compensated for in this embodiment by compensating for the grayscale values of the respective pixels so that the different grayscale values of the different pixels are compensated for by different compensation amplitudes, thus improving the difference in brightness between the displayed pictures of the image so as to enhance the sense of hierarchy. A bottleneck limiting the display brightness of the image in the areas of the pictures at high brightness is backlight peak brightness; and if the grayscale values of the pixels in the image are compensated for, then the brightness of the displayed image cannot be improved due to the limited maximum backlight peak brightness, so the backlight peak brightness will be improved in the areas of the pictures at high brightness to thereby address the sense of hierarchy in the picture. Thus each frame of pictures can be displayed by compensating grayscales of respective pixels in an area of a picture at low brightness to improve the sense of hierarchy in the picture, and enhancing backlight brightness of backlight zones in an area of a picture at high brightness to improve the sense of hierarchy in the picture, so that the overall sense of hierarchy in the image can be improved to thereby improve the effect of the dynamic contrast of the pictures.

Figure 10:
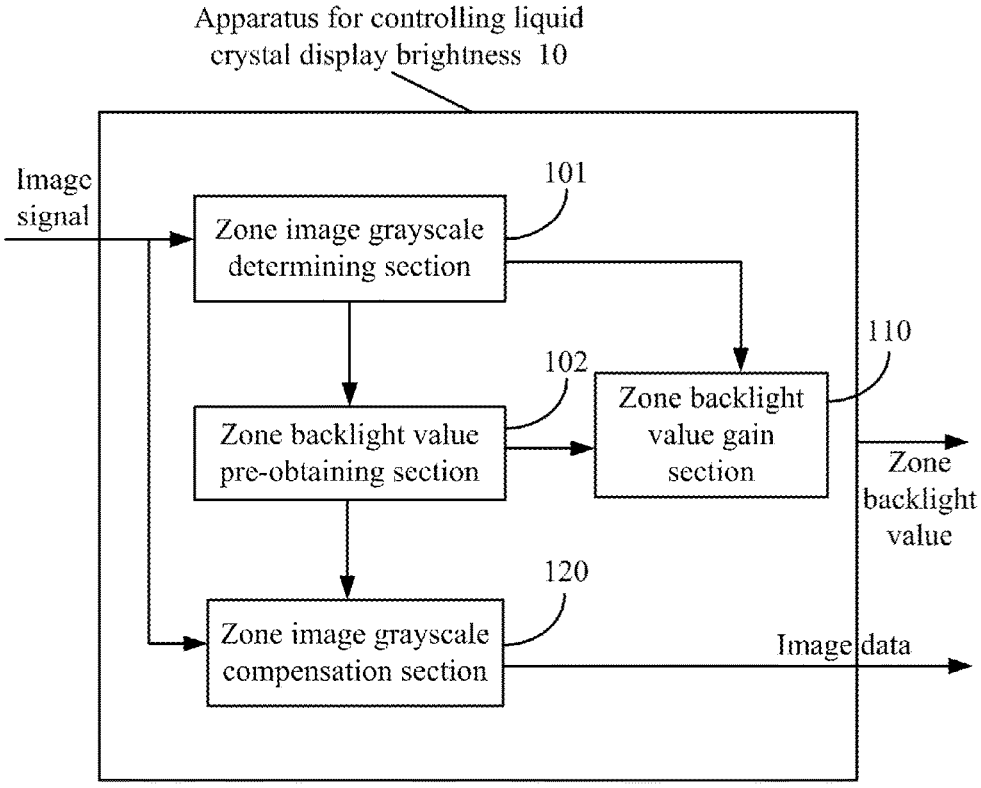
FIG. 10 is a schematic structural diagram of an apparatus for controlling liquid crystal display brightness according to a second embodiment of the disclosure.

As illustrated in FIG. 10 which is a schematic structural diagram of an apparatus for controlling liquid crystal display brightness according to a second embodiment of the disclosure, the apparatus 10 for controlling liquid crystal display brightness can be a single video processing chip or a number of video processing chips, e.g., two video processing chips, and the apparatus 10 for controlling liquid crystal display brightness can include:

A zone image grayscale determining section 101 is configured to determine grayscale values of pixels in a zone image data block under a predetermined rule according to a received image signal;

A zone backlight value pre-obtaining section 102 is configured to pre-obtain a zone backlight value corresponding to the zone image data block according to the grayscale values; and A zone backlight value gain section 110 is configured, when it is determined that the zone backlight value is above a first threshold, to multiply the pre-obtained zone backlight value with a backlight value gain coefficient to obtain a backlight value to which a gain is applied, of a backlight zone corresponding to the zone image data block, and to output the backlight value to which the gain is applied, to a driver circuit of backlight source in the backlight zone to control brightness of the backlight source in the backlight zone as a result of driving, where the backlight value gain coefficient is more than 1.

Figure 11:
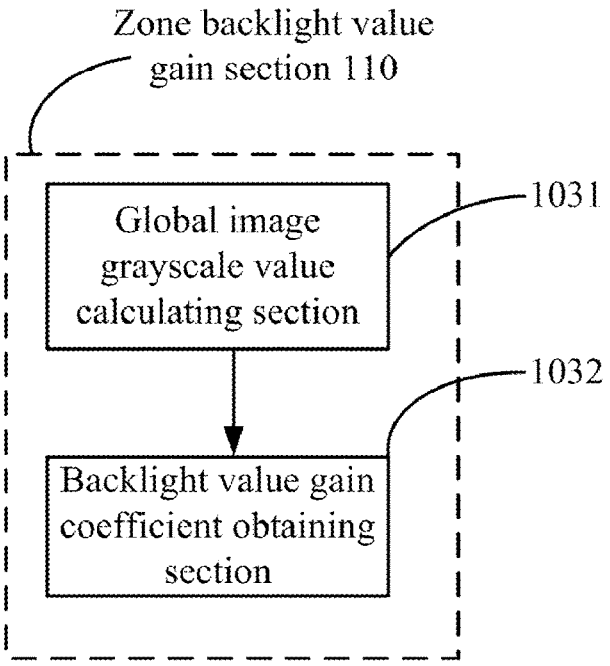
FIG. 11 is a schematic structural diagram of a zone backlight value gain section 110 in the second embodiment.

Furthermore FIG. 11 is a schematic structural diagram of the zone backlight value gain section 110 according to this second embodiment, where the zone backlight value gain section 110 particularly includes:

A global image grayscale value calculating section 1031 is configured to obtain an average grayscale value of a global image according to the grayscale values; and A backlight value gain coefficient obtaining section 1032 is configured to determine the backlight value gain coefficient according to a relationship between the average grayscale value of the global image and the backlight value gain coefficient.

Where a backlight value gain coefficient lookup table is preset in which the correspondence relationship between the average grayscale value of the global image and the preset backlight value gain coefficient is recorded, where the backlight value gain coefficient lookup table records a gain curve between the average grayscale value of the image, and the backlight value gain coefficient, and the gain curve is divided into a low brightness enhancement interval, a high brightness enhancement interval, and a power control interval while the average grayscale value of the image is increasing, where the gain coefficient in the high brightness enhancement interval is more than those in the low brightness enhancement interval and the power control interval respectively.

A zone image grayscale compensating section 120 is configured, when it is determined that the zone backlight value is below a second threshold, to compensate for the grayscale values of the pixels in the zone image data block using compensation coefficients to obtain compensated image data for driving a liquid crystal panel, where each of the compensation coefficient is more than 1.

Furthermore the zone image grayscale compensating section 120 configured to obtain the grayscale compensation coefficient is configured:

To search a preset grayscale compensation coefficient lookup table for the grayscale compensation coefficient using grayscale values in the zone image data block, where the grayscale compensation coefficient lookup table records the correspondence relationship between the grayscale value and the compensation coefficient.

Where a compensation curve of the correspondence relationship between the grayscale value and the grayscale compensation coefficient is an inverted "S"-like curve, where the traversal axis of the inverted "S"-like curve represents an input grayscale value, the vertical axis represents an output grayscale value.

For details about the functions and processing flows of the respective modules in the apparatus for controlling liquid crystal display brightness according to this second embodiment, reference can be made to the detailed description of the method for controlling liquid crystal display brightness according to the first embodiment above, so a repeated description thereof will be omitted here.

In this second embodiment, as can be apparent from the analysis above, in the areas of the pictures at low brightness, since the backlight brightness thereof is not a bottleneck limiting the brightness of the displayed image, the grayscale values of the pixels can be compensated for in this embodiment by compensating for the grayscale values of the respective pixels, and the compensated image data can be used to drive the liquid crystal panel to display the image, where the different grayscale values of the different pixels are compensated for by different compensation amplitudes, thus improving the difference in brightness between the displayed pictures of the image so as to enhance the sense of hierarchy. A bottleneck limiting the display brightness of the image in the area of the picture at high brightness is the backlight peak brightness; and if the grayscale values of the pixels in the image are compensated for, then the brightness of the displayed image cannot be improved due to the limited maximum backlight peak brightness, so the backlight peak brightness of the zone will be improved in the area of the picture at high brightness to thereby address the sense of hierarchy in the picture. Thus each frame of pictures can be displayed by compensating grayscales of respective pixels in an area of a picture at low brightness to improve the sense of hierarchy in the picture, and enhancing backlight brightness of the backlight zone in an area of a picture at high brightness to improve the sense of hierarchy in the picture, so that the overall sense of hierarchy in the image can be improved to thereby improve the effect of the dynamic contrast of the pictures.

Figure 12:
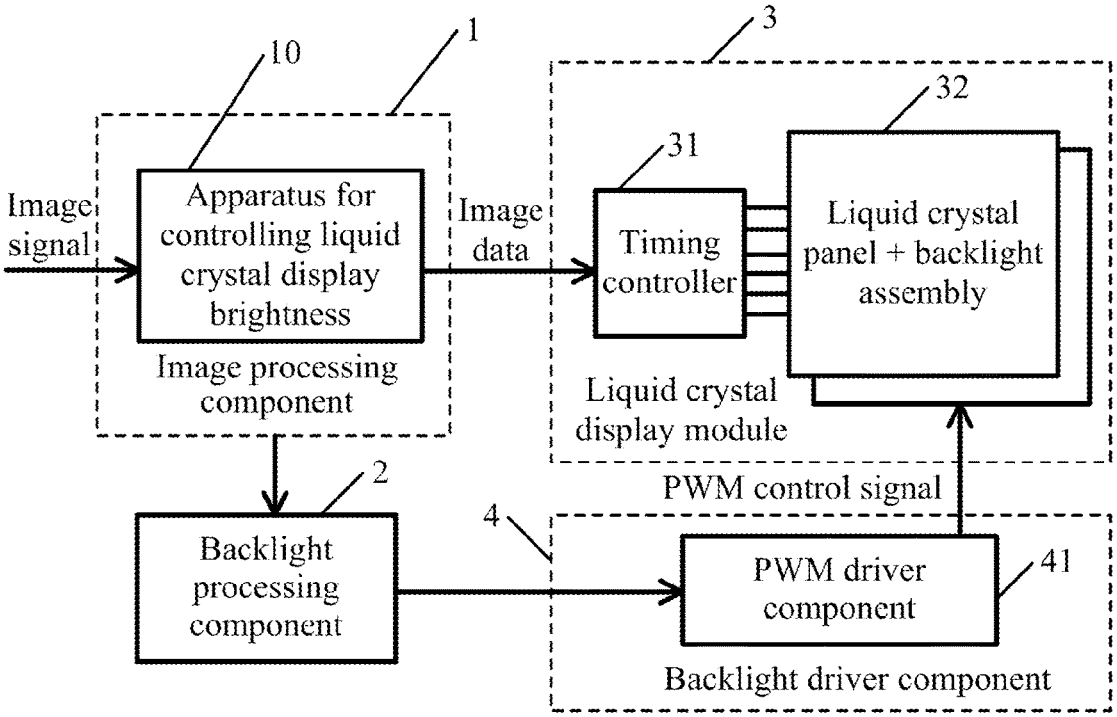
FIG. 12 is a schematic structural diagram of a liquid crystal display device according to a third embodiment of the disclosure.

FIG. 12 is a schematic structural diagram of a liquid crystal display device according to a third embodiment of the disclosure, where the liquid crystal display device includes an image processing component 1, a memory (not illustrated), a liquid crystal display module 3, a backlight processing module 2, and a backlight driver component 4, where:

The memory is configured to store programs and various preset lookup table data;

The image processing component 1 includes the apparatus 10 for controlling liquid crystal display brightness configured to execute the programs in the memory, and to invoke the various lookup table data according to the executed programs;

The apparatus 10 for controlling liquid crystal display brightness is further configured to receive an image signal, to process data, and to output image data to a timing controller (Tcon) in the liquid crystal display component 3 so that the Tcon generates a driver signal according to the image data to control a liquid crystal panel to display the image; and further configured to output zone backlight values to the backlight processing module 2 according to the image signal;

The backlight processing module 2 is configured to determine duty ratios of corresponding PWM signals according to the respective zone backlight values, and to output the duty ratios to a PWM driver module 41 in the backlight driver component 4; and The PWM driver module 41 is configured to generate PWM control signals to control backlight sources of zones in the backlight component 32.

Here the apparatus 10 for controlling liquid crystal display brightness is the apparatus for controlling liquid crystal display brightness according to the second embodiment, so a repeated description of the particular functions of the apparatus 10 for controlling liquid crystal display brightness is will be omitted here.

Figure 13:
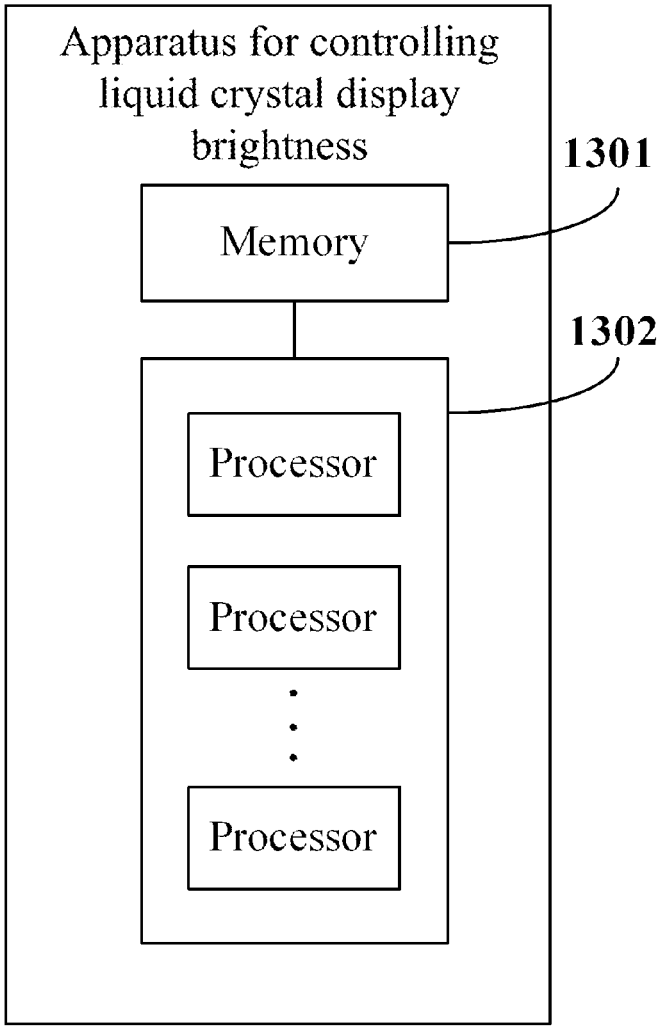
FIG. 13 is a schematic structural diagram of a liquid crystal display device an apparatus for controlling liquid crystal display brightness according to an embodiment of the disclosure.

As illustrated in FIG. 13, an embodiment of the disclosure provides an apparatus for controlling liquid crystal display brightness, the apparatus including a memory 1301 and one or more processors 1302, where the memory 1301 stores one or more computer readable program codes, and the one or more processors 1302 are configured to execute the one or more computer readable program codes to perform:

Determining grayscale values of pixels in a zone image data block under a predetermined rule according to a received image signal;

Pre-obtaining zone a backlight value corresponding to the zone image data block according to the grayscale values;

When it is determined that the zone backlight value is above a first threshold, then multiplying the pre-obtained zone backlight value with a backlight value gain coefficient to obtain a backlight value to which a gain is applied, of a backlight zone corresponding to the zone image data block, and outputting the backlight value to which the gain is applied, to a driver circuit of backlight source in the backlight zone to control brightness of the backlight source in the backlight zone as a result of driving, where the preset backlight value gain coefficient is more than 1; and When it is determined that the zone backlight value is below a second threshold, then compensating for the grayscale values using compensation coefficients to obtain compensated image data for driving a liquid crystal panel, where each of the compensation coefficient is more than 1.

Optionally the one or more processors 1302 are further configured to execute the one or more computer readable program codes to perform:

Searching a preset grayscale compensation coefficient lookup table for the grayscale compensation coefficient using grayscale values in the zone image data block, where the grayscale compensation coefficient lookup table records the correspondence relationship between the grayscale value and the compensation coefficient.

Optionally the one or more processors 1302 are further configured to execute the one or more computer readable program codes to perform:

Presetting a compensation curve of the correspondence relationship between the grayscale value and the grayscale compensation coefficient as an inverted "S"-like curve, where the traversal axis of the inverted "S"-like curve represents an input grayscale value, the vertical axis represents an output grayscale value.

Optionally the backlight value gain coefficient can be obtained by:

Obtaining an average grayscale value of a global image according to the grayscale values; and Determining the backlight value gain coefficient according to a relationship between the average grayscale value of the global image and the backlight value gain coefficient.

Optionally the relationship between the average grayscale value of the global image and the backlight value gain coefficient is preset in a backlight value gain coefficient lookup table.

Optionally the backlight value gain coefficient lookup table records a gain curve between the average grayscale value and the backlight value gain coefficient, and the gain curve is divided into a low brightness enhancement interval, a high brightness enhancement interval, and a power control interval while the average grayscale value of the image is increasing, where gain coefficients in the high brightness enhancement interval are more than those in the low brightness enhancement interval and the power control interval respectively.

Those ordinarily skilled in the art can appreciate that all or a part of the operations in the methods according to the embodiments described above can be performed by program instructing relevant hardware, where the programs can be stored in a computer readable storage medium, and the programs can perform one or a combination of the operations in the method embodiments upon being executed; and the storage medium includes an ROM, an RAM, a magnetic disc, an optical disk, or any other medium which can store program codes.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. An apparatus for controlling liquid crystal display brightness, the apparatus comprising:

a memory; and one or more processors, wherein the memory stores one or more computer readable program codes, and the one or more processors are configured to execute the one or more computer readable program codes to perform:

determining grayscale values of pixels in a zone image data block under a predetermined rule according to a received image signal;

pre-obtaining a zone backlight value corresponding to the zone image data block according to the grayscale values;

when it is determined that the zone backlight value is above a first threshold, multiplying the pre-obtained zone backlight value with a backlight value gain coefficient to obtain a backlight value, to which a gain is applied, of a backlight zone corresponding to the zone image data block, and outputting the backlight value to which the gain is applied to a driver circuit of a backlight source in the backlight zone to control brightness of the backlight source in the backlight zone as a result of driving, wherein the backlight value gain coefficient is more than 1; and when it is determined that the zone backlight value is below a second threshold, compensating for the grayscale values of the pixels in the zone image data block using compensation coefficients to obtain compensated image data for driving the liquid crystal panel, wherein each of the compensation coefficients is more than 1.

2. The apparatus of claim 1, wherein the one or more processors are further configured to execute the one or more computer readable program codes to perform:

searching a preset grayscale compensation coefficient lookup table for the grayscale compensation coefficients using the grayscale values in the zone image data block, wherein the grayscale compensation coefficient lookup table records correspondence relationships between the grayscale values and the compensation coefficients.

3. The apparatus of claim 2, wherein the one or more processors are further configured to execute the one or more computer readable program codes to perform:

presetting a compensation curve of the correspondence relationships between the grayscale values and the grayscale compensation coefficients as an inverted "S"-like curve, wherein a traversal axis of the inverted "S"-like curve represents an input grayscale value, and a vertical axis of the inverted "S"-like curve represents an output grayscale value.

4. The apparatus of claim 1, wherein the one or more processors are further configured to execute the one or more computer readable program codes to obtain the backlight value gain coefficient by:

obtaining an average grayscale value of pixels of an image according to the grayscale values of the image; and determining the backlight value gain coefficient according to a relationship between the average grayscale value and the backlight value gain coefficient.

5. The apparatus of claim 4, wherein the one or more processors are further configured to execute the one or more computer readable program codes to preset the relationship between the average grayscale value and the backlight value gain coefficient in a backlight value gain coefficient lookup table.

6. The apparatus of claim 5, wherein the one or more processors are further configured to execute the one or more computer readable program codes to make the backlight value gain coefficient lookup table record a gain curve between the average grayscale value of pixels of an image and the backlight value gain coefficient, wherein the gain curve is divided into a low brightness enhancement interval, a high brightness enhancement interval, and a power control interval while the average grayscale value of the image is increasing, and wherein backlight value gain coefficients in the high brightness enhancement interval are more than those in the low brightness enhancement interval and the power control interval.

7. A method for controlling liquid crystal display brightness, the method comprising:

determining grayscale values of pixels in a zone image data block under a predetermined rule according to a received image signal;

pre-obtaining a zone backlight value corresponding to the zone image data block according to the grayscale values;

when it is determined that the zone backlight value is above a first threshold, multiplying the zone backlight value with a backlight value gain coefficient to obtain a backlight value to which a gain is applied, of a backlight zone corresponding to the zone image data block, and outputting the backlight value to which the gain is applied to a driver circuit of a backlight source in the backlight zone to control brightness of the backlight source in the backlight zone as a result of driving, wherein the backlight value gain coefficient is more than 1; and when it is determined that the zone backlight value is below a second threshold, compensating for the grayscale values of the pixels in the zone image data block using grayscale compensation coefficients to obtain compensated image data for driving a liquid crystal panel, wherein each of the compensation coefficients is more than 1.

8. The method of claim 7, wherein the compensation coefficient is obtained by:

searching a preset grayscale compensation coefficient lookup table for the grayscale compensation coefficients using the grayscale values of pixels in the zone image data block, wherein the grayscale compensation coefficient lookup table records correspondence relationships between the grayscale values and the compensation coefficients.

9. The method of claim 8, wherein a compensation curve of the correspondence relationships between the grayscale values and the grayscale compensation coefficients is an inverted "S"-like curve, wherein a traversal axis of the inverted "S"-like curve represents an input grayscale value, and a vertical axis of the inverted "S"-like curve represents an output grayscale value.

10. The method of claim 7, wherein the backlight value gain coefficient is obtained by:

obtaining an average grayscale value of pixels of an image according to the grayscale values of the pixels of the image; and determining the backlight value gain coefficient according to a relationship between the average grayscale value and the backlight value gain coefficient.

11. The method of claim 8, wherein a relationship between the average grayscale value and the backlight value gain coefficient is preset in a backlight value gain coefficient lookup table.

12. The method of claim 11, wherein the backlight value gain coefficient lookup table records a gain curve between the average grayscale value and the backlight value gain coefficient, wherein the gain curve is divided into a low brightness enhancement interval, a high brightness enhancement interval, and a power control interval while the average grayscale value of the image is increasing, and wherein backlight value gain coefficients in the high brightness enhancement interval are more than those in the low brightness enhancement interval and the power control interval.

13. A liquid crystal display device, comprising:

a memory configured to store programs and various preset lookup table data;

an apparatus for controlling liquid crystal display brightness, the apparatus configured to execute the programs in the memory, to invoke the various lookup table data according to the executed programs, to receive an image signal, to process data, and to output image data to a timing controller so that the timing controller generates a driver signal according to the image data to control a liquid crystal panel to display an image, and to output zone backlight values to a backlight processing module according to the image signal;

wherein the backlight processing module is configured to determine duty ratios of corresponding PWM signals according to the respective zone backlight values, and to output the duty ratios to a PWM driver module;

wherein the PWM driver module is configured to generate PWM control signals to control backlight sources in backlight zones;

wherein the apparatus for controlling liquid crystal display brightness comprises an apparatus memory and one or more processors, wherein the apparatus memory stores one or more computer readable program codes, and the one or more processors are configured to execute the one or more computer readable program codes to perform:

determining grayscale values in a zone image data block under a predetermined rule according to a received image signal;

pre-obtaining a zone backlight value corresponding to the zone image data block according to the grayscale values;

when it is determined that the zone backlight value is above a first threshold, multiplying the pre-obtained zone backlight value with a backlight value gain coefficient to obtain s backlight value to which a gain is applied, of a backlight zone corresponding to the zone image data block, and outputting the backlight value to which the gain is applied to a driver circuit of backlight source in the backlight zone to control brightness of the backlight source in the backlight zone as a result of driving, wherein the backlight value gain coefficient is more than 1; and when it is determined that the zone backlight value is below a second threshold, compensating for the grayscale values of pixels in the zone image data block using compensation coefficients to obtain compensated image data for driving a liquid crystal panel, wherein each of the compensation coefficients is more than 1.

14. The liquid crystal display device of claim 13, wherein the one or more processors are further configured to execute the one or more computer readable program codes to perform:

searching a preset grayscale compensation coefficient lookup table for the grayscale compensation coefficients using the grayscale values in the zone image data block, wherein the grayscale compensation coefficient lookup table records correspondence relationships between the grayscale values and the compensation coefficients.

15. The apparatus of claim 14, wherein the one or more processors are further configured to execute the one or more computer readable program codes to perform:

presetting a compensation curve of the correspondence relationships between the grayscale values and the grayscale compensation coefficients as an inverted "S"-like curve, wherein a traversal axis of the inverted "S"-like curve represents an input grayscale value, and a vertical axis of the inverted "S"-like curve represents an output grayscale value.

16. The apparatus of claim 13, wherein the one or more processors are further configured to execute the one or more computer readable program codes to obtain the backlight value gain coefficient by:

obtaining an average grayscale value of pixels of an image according to the grayscale values of the image; and determining the backlight value gain coefficient according to a relationship between the average grayscale value and the backlight value gain coefficient.

17. The apparatus of claim 16, wherein the one or more processors are further configured to execute the one or more computer readable program codes to preset the relationship between the average grayscale value and the backlight value gain coefficient in a backlight value gain coefficient lookup table.

18. The apparatus of claim 17, wherein the one or more processors are further configured to execute the one or more computer readable program codes to make the backlight value gain coefficient lookup table record a gain curve between the average grayscale value of pixels of an image and the backlight value gain coefficient, wherein the gain curve is divided into a low brightness enhancement interval, a high brightness enhancement interval, and a power control interval while the average grayscale value of the image is increasing, and wherein backlight value gain coefficients in the high brightness enhancement interval are more than those in the low brightness enhancement interval and the power control interval respectively.

* * * * *